US011808079B2

(12) United States Patent
Liang et al.

(10) Patent No.: US 11,808,079 B2
(45) Date of Patent: Nov. 7, 2023

(54) INNER FRAME FOR DOOR OR WINDOW, SKYLIGHT COMPRISING THE SAME AND MANUFACTURING METHOD THEREOF

(71) Applicant: SICHUAN MCWELL VENTILATION EQUIPMENT CO., LTD., Sichuan (CN)

(72) Inventors: Peng Liang, Sichuan (CN); Zhibin Hu, Sichuan (CN); Quanbo Hu, Sichuan (CN)

(73) Assignee: SICHUAN MCWELL VENTILATION EQUIPMENT CO., LTD., Sichuan (CN)

( * ) Notice: Subject to any disclaimer, the term of this patent is extended or adjusted under 35 U.S.C. 154(b) by 225 days.

(21) Appl. No.: 17/364,917

(22) Filed: Jul. 1, 2021

(65) Prior Publication Data

US 2021/0324675 A1 Oct. 21, 2021

Related U.S. Application Data

(63) Continuation of application No. PCT/CN2020/118491, filed on Sep. 28, 2020.

(30) Foreign Application Priority Data

Dec. 20, 2019 (CN) ..... 201911322353.2
Apr. 27, 2020 (CN) ..... 202010346627.8

(51) Int. Cl.
*E06B 3/54* (2006.01)
*E04D 13/03* (2006.01)
(Continued)

(52) U.S. Cl.
CPC ..... *E06B 3/549* (2013.01); *E04D 13/0305* (2013.01); *E06B 3/26* (2013.01); *E06B 3/263* (2013.01); *E06B 7/2307* (2013.01)

(58) Field of Classification Search
CPC ..... E04D 13/0305; E06B 3/549; E06B 3/26; E06B 3/263; E06B 7/2307
See application file for complete search history.

(56) References Cited

U.S. PATENT DOCUMENTS 4,409,767 A * 10/1983 Jentoft ..... E04D 13/0305 52/204.591
4,757,655 A * 7/1988 Jentoft ..... E04D 13/0305 52/204.591

(Continued)

FOREIGN PATENT DOCUMENTS

CN 1619077 5/2005
CN 2749976 1/2006

(Continued)

*Primary Examiner* — Andrew J Triggs
(74) *Attorney, Agent, or Firm* — COOPER LEGAL GROUP, LLC

(57) ABSTRACT

An inner frame of a door or a window is disclosed. The inner frame is disposed at an inner side of a window sash, and is connected between a jamb of the door or the window sash and a door frame or a window frame. The inner frame includes a fixing portion for fixing to the jamb, a water baffle, and a connecting portion for connecting with the door frame or the window frame. One side of the fixing portion is fixed to the jamb, the water baffle is integrally disposed on the other side of the fixing portion opposite to the one side, and the connecting portion is integrally disposed on a side of the water baffle facing away from the fixing portion and is connected to the door frame or the window frame.

10 Claims, 4 Drawing Sheets

(51) Int. Cl.

| | |
|---|---|
| ***E06B 3/26*** | (2006.01) |
| ***E06B 3/263*** | (2006.01) |
| ***E06B 7/23*** | (2006.01) |

(56) References Cited

U.S. PATENT DOCUMENTS

| | | | | | |
|---|---|---|---|---|---|
| 4,788,804 | A * | 12/1988 | Haas | E04D 13/0305 | 52/204.591 |
| 4,926,594 | A * | 5/1990 | Sampson | E04D 13/0305 | 52/656.5 |
| 4,930,275 | A * | 6/1990 | Verby | E04D 13/0305 | 52/200 |
| 5,044,133 | A * | 9/1991 | Sampson | E04D 13/0305 | 49/495.1 |
| 5,216,855 | A * | 6/1993 | Richter | E06B 3/5821 | 52/204.593 |
| 5,355,644 | A * | 10/1994 | Guhl | E04D 13/0305 | 52/200 |
| 5,544,455 | A * | 8/1996 | DeBlock | E04B 9/32 | 52/220.8 |
| 5,682,713 | A * | 11/1997 | Weiss | E04D 13/031 | 403/231 |
| 5,913,785 | A * | 6/1999 | Møller | E04D 13/0305 | 52/220.8 |
| 6,263,623 | B1 * | 7/2001 | Weiss | E04D 13/0305 | 52/200 |
| 9,140,050 | B2 * | 9/2015 | Lindgren | E06B 1/36 | |
| 9,453,343 | B1 * | 9/2016 | Brinton | E04D 13/0315 | |
| 10,519,665 | B2 * | 12/2019 | Bunker, II | E04D 13/031 | |
| 11,118,355 | B2 * | 9/2021 | Clark, Jr. | B60J 1/00 | |
| 2005/0000173 | A1 * | 1/2005 | Lindgren | E06B 7/2301 | 52/200 |
| 2017/0040929 | A1 * | 2/2017 | Ting | F24S 25/37 | |
| 2020/0062088 | A1 * | 2/2020 | Veeneman | F16B 2/245 | |
| 2021/0324675 | A1 * | 10/2021 | Liang | E04D 13/0305 | |

FOREIGN PATENT DOCUMENTS

| | | | |
|---|---|---|---|
| CN | 201284600 | | 8/2009 |
| CN | 102912943 | | 2/2013 |
| CN | 202745247 | | 2/2013 |
| CN | 204646022 | | 9/2015 |
| CN | 204646022 | U * | 9/2015 |
| CN | 106678000 | | 5/2017 |
| CN | 109339358 | | 2/2019 |
| CN | 209429847 | | 9/2019 |
| CN | 111075311 | | 4/2020 |
| CN | 111335797 | | 6/2020 |
| CN | 211058169 | | 7/2020 |
| CN | 211549351 | | 9/2020 |
| JP | 36480692 | | 3/1989 |
| KR | 20170031903 | | 3/2017 |

* cited by examiner

INNER FRAME FOR DOOR OR WINDOW, SKYLIGHT COMPRISING THE SAME AND MANUFACTURING METHOD THEREOF

CROSS-REFERENCE TO RELATED APPLICATION

The present application is a continuation of international application of PCT application No. PCT/CN2020/118491, filed on Sep. 28, 2020, which claims the priority benefit of China application No. 201911322353.2, filed on Dec. 20, 2019 and China application No. 202010346627.8, filed on Apr. 27, 2020. The entirety of each of the above-mentioned patent applications is hereby incorporated by reference herein and made a part of this specification.

BACKGROUND

Technical Field

The present application relates to the field of a door or window, and in particular, to an inner frame of a door or a window, a skylight comprising the same and a manufacturing method thereof.

Description of Related Art

As technology advances, a door or window is often provided in buildings for ventilation and/or daylighting. Taking a window as an example, the window is generally formed by combining a window frame and a window sash, in order to guarantee the sealing performance between the window sash and the window frame, a sealing assembly needs to be arranged to seal a gap between the window sash and the window frame, and particularly in an openable and closable skylight, the requirement for the sealing performance is very high. The window sash is generally composed of a jamb and a glass plate arranged on the jamb, although the window sash can achieve a good daylighting effect, the traditional door or window are poor in sealing performance, and rainwater easily enters a room from the connecting portion between the jamb and the glass plate.

The existing window sash is connected with a inner profile frame, and the inner profile frame is provided with an annular water blocking portion, to improve the waterproof effect of the window sash. However, for processing and assembly convenience, the inner profile frame is formed by splicing four inner profiles, and the jamb is also formed by splicing four outer profiles, and the outer profiles are snap-fitted onto the inner profiles and the glass plate through horizontal extrusion. According to the assembled skylight, rainwater easily enters the space between the jamb and the annular water blocking portion from the connecting position of the adjacent outer profiles, and then enters the room from the connecting position of the adjacent inner profiles, and therefore, the expected waterproof effect cannot be achieved.

SUMMARY

In view of the disadvantages in the prior art, one of the objects of the present application is to provide a door or window, which has the advantages of facilitating the processing and assembly of an inner profile frame and improving the waterproof effect.

The one of the above objects of the present application is achieved by the following technical solutions.

An inner frame for a door or a window, in which the inner frame is disposed at an inner side of a window sash, and is connected between a jamb of a door sash or a window sash and a window frame. The inner frame includes a fixing portion for fixing to the jamb of the door sash or the window sash, a water baffle, and a connecting portion for connecting with the door frame or the window frame. One side of the fixing portion is fixed to the jamb of the door sash or the window sash, the water baffle is integrally disposed on the other side of the fixing portion opposite to the one side, and the connecting portion is integrally disposed on a side of the water baffle facing away from the fixing portion and is connected to the door frame or the window frame. A glass plate of the door or the window is held between the jamb of the door sash or the window sash and a side edge of the water baffle facing the glass plate.

Preferably, the fixing portion includes a first fixing piece disposed on the jamb and a second fixing piece integrally disposed with water baffle, and the second fixing piece is detachably connected to the first fixing piece.

Preferably, the first fixing piece is in snap-fit engagement with the second fixing piece.

Preferably, the second fixing piece has a substantially U-shaped cross section in which a flat bottom is detachably connected to the first fixing piece.

Preferably, the connecting portion is a plate-shaped connecting portion, and one side surface of the plate-shaped connecting portion abuts against the door frame or the window frame.

Preferably, the side edge of the water baffle facing away from the glass plate extends beyond a position where the connecting portion abuts against the door frame or the window frame in a direction away from the glass plate.

Preferably, the inner frame further includes a second connecting portion which is also plate-shaped, the second connecting portion is disposed opposite to and parallel to the plate-shaped connecting portion, and the second connecting portion is disposed adjacent to the glass plate and fixed to the water baffle.

Preferably, the inner frame further includes a mullion. The mullion is mounted on the water baffle via the connecting portion.

Preferably, a first seal is provided between the side edge of the water baffle facing the glass plate and the glass plate, and a second seal is provided between the connecting portion and the door frame or the window frame.

Preferably, a heat insulating strip is provided between the second fixing piece and the first fixing piece.

According to another aspect of the present application, there is provided a nail-free and glue-free skylight, including an outer profile frame, an inner profile frame, and a glass plate disposed between the outer profile frame and the inner profile frame. The outer profile frame is formed by splicing a plurality of outer profiles, and a first fixing piece is disposed on an inner side surface of the outer profile frame. The inner profile frame includes an annular water blocking portion, and the annular water blocking portion is formed by bending a water baffle. A junction of ends of the water baffle directly faces any of the outer profiles, an outer side surface of the annular water blocking portion is disposed with a second fixing piece, and the first fixing piece is in snap-fit engagement with the second fixing piece.

By adopting the above technical solutions, the outer profile frame and the annular water blocking portion are connected by cooperation of the first fixing piece and the second fixing piece, and the two are not connected by bolts, and therefore, the phenomenon that rainwater enters the room from the junction does not occur, and the waterproof effect of the skylight is improved. The annular water blocking portion is formed by bending one water baffle, so that the inner profile frame is easy and quick to process and assemble. Further, the annular water blocking portion is integrated at the collision corner, so that rainwater can be reduced from entering the room from the collision corner of the annular water blocking portion, and the waterproof effect of the skylight is improved.

In a preferred embodiment, the nail-free and glue-free skylight further includes a window frame, a connecting portion is disposed at one side of the water baffle away from the second fixing piece, and a bottom of the water baffle protrudes a lower surface of the connecting portion.

By adopting the above technical solutions, the protruding portion of the water baffle may play a role of guiding water, that is, guiding rainwater entering the skylight from the collision corner of the outer profile frame.

In a preferred embodiment, when the skylight is closed, a lower end surface of the water baffle is lower than an upper end surface of the window frame.

By adopting the above technical solutions, the rainwater entering the skylight flows downward under the guidance of the water baffle, and since the lower end surface of the water baffle is lower than the upper end surface of the window frame, the rainwater entering the room from the water baffle through the window frame is reduced.

In a preferred embodiment, a gap is left between adjacent second connecting portions.

By adopting the above technical solutions, rainwater can enter the skylight through the collision corner of the outer profile frame, and flow outside the room from the gap of the second fixing pieces, that is, a channel is provided for drainage of the rainwater, thereby further improving the waterproof effect of the skylight.

In a preferred embodiment, the nail-free and glue-free skylight further includes a mullion, and the mullion is mounted on the water baffle via the connecting portion.

By adopting the above technical solutions, the mullion can increase the structural strength of the skylight, most of the existing skylight is opened and closed by the air cylinder, and the piston rod of the air cylinder is mounted on the mullion, so that the damage of the skylight is reduced.

In a preferred embodiment, the water baffle is provided with a first seal abutting against the glass plate, and the window frame is provided with a second seal abutting against the connecting portion.

By adopting the above technical solutions, the first seal abuts on the glass plate, thereby further improving the waterproof effect of the skylight. By means of the second seal, rainwater can be reduced from entering the room between the window frame and the annular water blocking portion.

In a preferred embodiment, a heat insulating strip is provided between the second fixing piece and the first fixing piece.

By adopting the above technical solutions, the heat insulating strip can reduce the heat outside the room from entering the room through the outer profiles and the inner profiles.

In a preferred embodiment, a surface of the second fixing piece is provided with a sliding rail, and the heat insulating strip is slidably connected to the sliding rail.

By adopting the above technical solutions, the heat insulating strip slides into the end portion of the second fixing piece, so that the heat insulating strip can be mounted more easily.

Another of the above objects of the present application is achieved by the following technical solutions.

A method for manufacturing a nail-free and glue-free skylight, comprising the following steps.

Step S1, processing an outer profile: cutting two ends of the outer profile, so that a plurality of outer profiles are capable of being spliced into an outer profile frame;

Step S2, processing an inner profile: cutting off the second fixing piece at a portion of a water baffle to be bent, and cutting the connecting portion at a portion of the water baffle to be bent, so that the connecting portion is capable of being spliced into a shape matched with the inner profile frame, after bending the water baffle;

Step S3, molding the inner profile frame: bending the water baffle to make two ends of the water baffle abut against each other, and mounting a first seal on the water baffle; and Step S4, assembling: placing the inner profile frame on an operation table, placing the glass plate on the inner profile frame, and then inserting the outer profile from a side surface of the inner profile frame and the glass plate, so that the second fixing piece is snap-fitted into the first fixing piece.

By adopting the above technical solutions, the annular water blocking portion is formed by bending one water baffle, so that the inner profile frame is easy and quick to process and assemble. Further, the annular water blocking portion is integrated at the collision corner, so that rainwater can be reduced from entering the room from the collision corner of the annular water blocking portion, and the waterproof effect of the skylight is improved.

In a preferred embodiment, before the step S4, a heat insulating strip is provided between the second fixing piece and the first fixing piece; and in the step S4, an corner brace is inserted between two adjacent outer profiles, and the outer profiles are abutted against the corner brace by an compression device.

By adopting the above technical solutions, the heat insulating strip can reduce the heat outside the room from entering the room through the jamb and the inner profiles. The corner brace connects the adjacent outer profiles, so that the outer profiles are assembled on the annular blocking portion and the glass plate more firmly.

In summary, the present application includes at least one of the following beneficial effects.

1. The annular water blocking portion is formed by bending one water baffle, so that the inner profile frame is easy and quick to process and assemble. Further, the annular water blocking portion is integrated at the collision corner, so that rainwater can be reduced from entering the room from the collision corner of the annular water blocking portion, and the waterproof effect of the skylight is improved.

2. The outer profile frame and the annular water blocking portion are connected by cooperation of the first fixing piece and the second fixing piece, and the two are not connected by bolts, and therefore, the phenomenon that rainwater enters the room from the junction does not occur, and the waterproof effect of the skylight is improved.

3. The first seal is mounted on the water baffle, and the first seal abuts on the glass plate, thereby further improving the waterproof effect of the skylight.

DESCRIPTION OF THE EMBODIMENTS

The application will be further described in detail below with reference to the accompanying drawings. In the following paragraphs, various aspects of the embodiments are defined in more detail. Aspects so defined may be combined with any other aspect or aspects unless explicitly indicated to the contrary. In particular, any feature considered to be preferred or advantageous may be combined with one or more other features considered to be preferred or advantageous.

The terms "first", "second" and the like, appearing in this application are merely for convenience of description, to distinguish different components having the same name and do not represent a sequential or primary-secondary relationship. In the description of the present application, terms such as "inside" and "outside" are used, in which "inside" represents an indoor portion of a building where the door or window are located, and "outside" represents an outdoor portion of the building where the door or window are located.

For purposes of brevity, in the following embodiments, window sashes and window frames will be described by way of example only. Of course, the present application also relates to a door and to an inner frame applied to a door.

Figure 1:
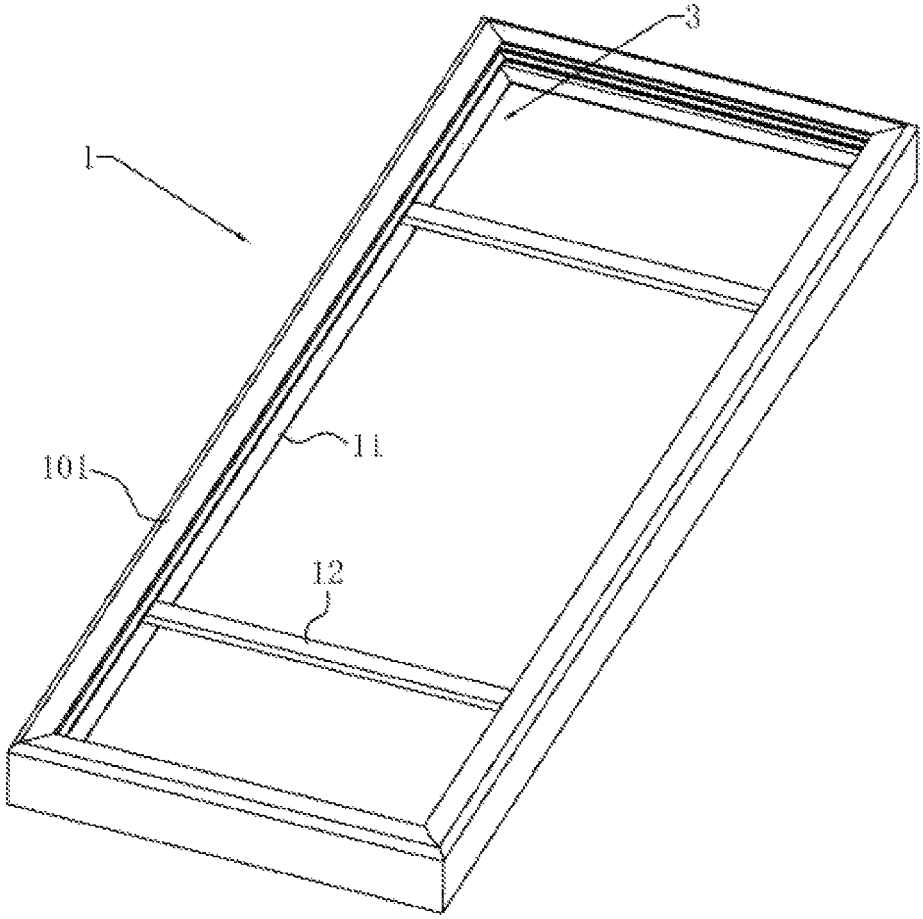
FIG. 1 is a schematic structural diagram according to an embodiment of the present application.
Figure 2:
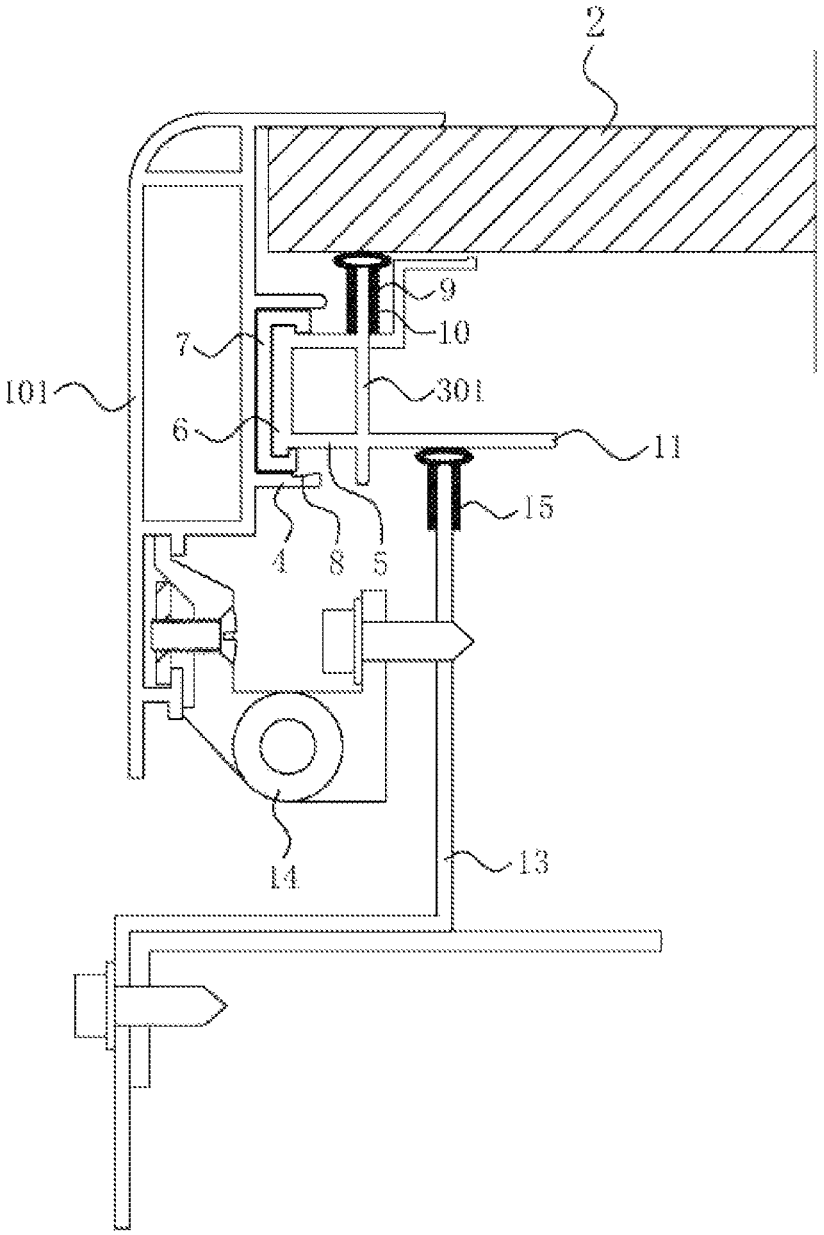
FIG. 2 is a partial cross-sectional view according to an embodiment of the present application.

As shown in FIGS. 1 and 2, the window of the present application includes a window frame 13 and a window sash, and the window sash includes a jamb 101 and a glass plate 2. Besides, the window of the present application further includes an inner frame which is disposed at an inner side of the window sash, and connected between the jamb 101 and the window frame 13. The inner frame includes a fixing portion for fixing to the jamb 101 of the window sash, a water baffle 301, and a connecting portion 11 for connecting with the window frame 13.

As shown in FIG. 2, preferably, the fixing portion includes a first fixing piece 4 disposed on the jamb 101 and a second fixing piece 5 integrally disposed with water baffle 301, and the second fixing piece 5 is detachably connected to the first fixing piece 4. Preferably, the first fixing piece 4 is formed by two pieces of plates which are perpendicular to the jamb 101 and fixedly connected to the jamb 101 at parallel intervals, thereby forming a groove-like structure. In this case, the second fixing piece 5 has a substantially U-shaped cross section in which a flat bottom is detachably connected to the first fixing piece 4. For example, the first fixing piece 4 is in snap-fit engagement with the second fixing piece 5 at the bottom of the first fixing piece 4. Preferably, a heat insulating strip 7 is provided between the second fixing piece 5 and the first fixing piece 4. Thereby, one side of the fixing portion is fixed to the window sash, and thus the inner frame is fixed to the jamb 101.

As shown in FIG. 2, the water baffle 301 is plate-shaped. The water baffle 301 is integrally disposed on the other side of the fixing portion opposite to the one side. Preferably, the water baffle 301 is disposed at the opening side of the substantially U-shaped second fixing piece 5, so that one side of the water baffle 301 closes the substantially U-shaped second fixing piece 5. A side edge of the water baffle 301 facing the glass plate extends to abut against the glass plate 2 so that the glass plate 2 is held between the jamb 101 and the side edge of the water baffle 301 facing the glass plate 2. Preferably, a first seal 9 is provided between the glass plate 2 and the side edge of the water baffle 301 facing the glass plate 2, to block rainwater from entering the inner side of the window sash.

As shown in FIG. 2, the connecting portion 11 is integrally disposed on the side of the water baffle 301 facing away from the fixing portion and is connected to the window frame 13. In particular, the connecting portion 11 is plate-shaped, and one side surface of the plate-shaped connecting portion 11 abuts against the window frame 13. Preferably, a second seal 15 is provided between the connecting portion 11 and the window frame 13, to block rainwater from entering the inner side of the window sash.

Further, it is preferable that the side edge of the water baffle 301 facing away from the glass plate 2 extends beyond a position where the connecting portion 11 abuts against the window frame 13 in a direction away from the glass plate 2, thereby achieving the effect of blocking rainwater.

Preferably, as shown in FIG. 2, the inner frame further includes a second connecting portion which is also plate-shaped, the second connecting portion is disposed opposite to and parallel to the plate-shaped connecting portion 11, and the second connecting portion is disposed adjacent to the glass plate 2 and fixed to the water baffle 301, for example, fixedly connected to the water baffle 301 by a bending portion.

Further, as shown in FIGS. 1 and 2, there is provided a nail-free and glue-free skylight, which includes an outer profile frame 1, a glass plate 2, and an inner profile frame 3, in particular, the glass plate 2 is disposed between the outer profile frame 1 and the inner profile frame 3, the outer profile frame 1 is formed by splicing a plurality of outer profiles, and the inner side surface of the outer profile frame 1 is integrally formed with a first fixing piece 4. In this embodiment, there are four outer profiles, so that the spliced outer profile frame 1 is rectangular. In other embodiments, the spliced outer profile frame also can be triangular, regular polygonal, etc. The glass plate 2 is made of glass, and may also be made of other daylighting materials. The inner profile frame 3 includes an annular water blocking portion, and the outer side surface of the annular water blocking portion is integrally formed with a second fixing piece 5, and the first fixing piece 4 is in snap-fit engagement with the second fixing piece 5. In particular, the shape of the outer profile frame 1 matches with that of the inner profile frame 3.

The first fixing piece 4 in this embodiment includes two connecting plates which are parallel to each other, and the two connecting plates and the outer profile frame 1 form a concave portion. The second fixing piece 5 is a convex portion, the convex portion matches the concave portion, and the convex portion is snap-fitted into the concave portion, so as to connect the water blocking portion and the outer profile frame 1 together. In other embodiments, the first fixing piece 4 is a convex portion, and the second fixing piece 5 is a concave portion, and other similar structures may also be used to connect the annular water blocking portion and the outer profile frame 1 together.

The inside of the second fixing piece 5 is a hollow structure, and the weight of the second fixing piece 5 can be reduced on the premise of ensuring the structural strength of the second fixing piece 5. The surface of the second fixing piece 5 is integrally formed with a sliding rail 6, and a heat insulating strip 7 is slidably connected to the sliding rail 6. The heat insulating strip 7 slides into the end portion of the second fixing piece 5, so that the heat insulating strip 7 can be mounted more easily, and the heat insulating strip 7 can reduce the heat outside the room from entering the room through the outer profile and the inner profiles. A guide groove 8 is formed in the first fixing piece 4 and can guide the second fixing piece 5 to be snap-fitted into the first fixing piece 4, thereby making it easier to assemble the outer profile to the annular water blocking portion and the glass plate 2.

Figure 3:
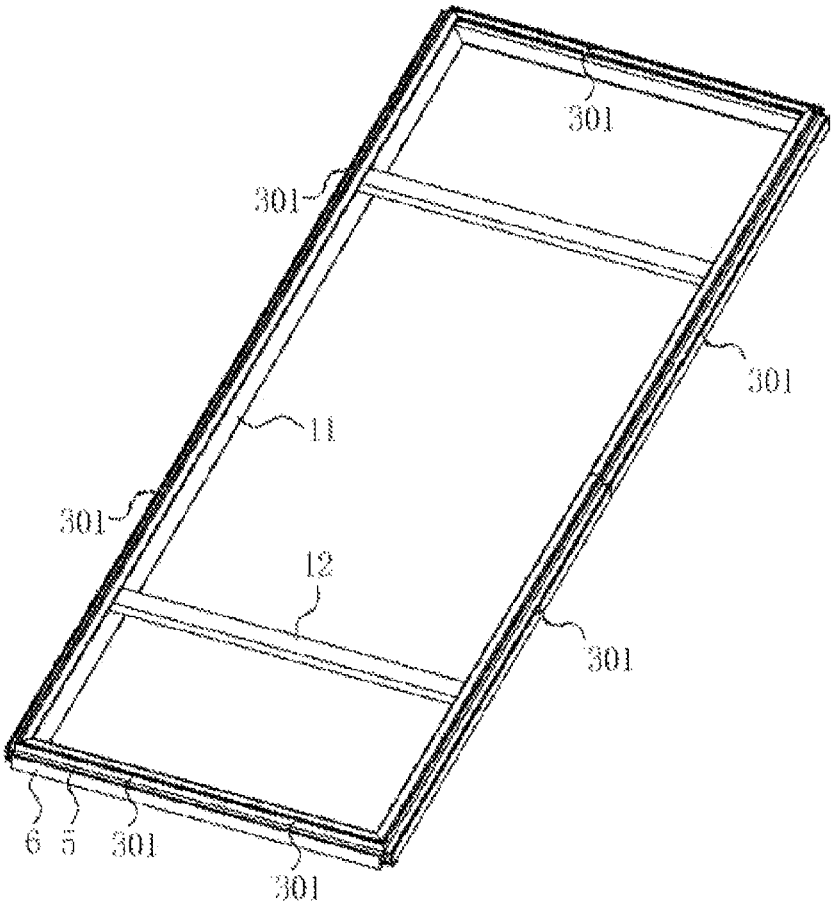
FIG. 3 is schematic structural diagram of a water baffle, a second fixing piece and a connecting portion according to an embodiment of the present application.

As shown in FIGS. 2 and 3, the annular water blocking portion is formed by bending the water baffle 301, the junction of the head end and the tail end of the water baffle 301 directly faces any of the outer profiles, that is, a junction of the two ends of the water baffle 301 is not located at the collision corner of the annular water blocking portion. The head and tail ends of the water baffle 301 may be connected together by welding or may be directly abutted against. The annular water blocking portion is formed by bending one water baffle 301, so that the inner profile frame 3 is easy and quick to process and assemble. Further, the annular water blocking portion is integrated at the collision corner, so that rainwater can be reduced from entering the room from the collision corner of the annular water blocking portion, and the waterproof effect of the skylight is improved. A gap is left between adjacent second connecting portions 5, so that rainwater can enter the skylight through the collision corner of the outer profile frame 1, and flow outside the room from the gap of the second fixing pieces 5, that is, a channel is provided for drainage of the rainwater.

The water baffle 301 is inserted with a first seal 9 abutting against the glass plate 2, the first seal 9 matches with the bent water baffle 301, and the first seal 9 is a rubber sealing strip with a U-shaped cross section. The first seal 9 is sleeved on the water baffle 301, which can reduce the occurrence of falling-off when the outer profile is assembled on the annular water blocking portion. Furthermore, the first seal 9 abuts on the glass plate 2, thereby further improving the waterproof effect of the skylight. The surface of the water baffle 301 is integrally formed with the anti-slip rib 10, and the anti-slip rib 10 can reduce the first seal 9 from falling off the water baffle 301.

The skylight further includes a window frame 13, the window frame 13 is located below the annular water blocking portion, and the outer profile frame 1 is movably connected to the window frame 13 via a mounting member 14. Like the conventional window frame 13, the window frame 13 in this embodiment is also mounted on the roof, and the window frame and the window sash together constitute a window. The mounting member 14 may be a hinge or a gemel, and the outer profile frame 1 can be reversed by the hinge or the gemel, thereby realizing the opening or closing of the window. In particular, the junction between the head and tail ends of the water baffle 301 is located on the side of the window close to the mounting member 14.

The water baffle 301 is provided with a connecting portion 11 on a side away from the second fixing piece 5, the connecting portion 11 is a horizontal plate, and the connecting portion 11 is integrally formed on a side surface of the water baffle 301. The lower surface of the connecting portion 11 abuts against the upper surface of the window frame 13, and the lower surface of the water baffle 301 is lower than the upper surface of the window frame 13. The protruding portion of the water baffle 301 may play a role of guiding water, that is, guiding rainwater entering the skylight from the collision corner of the outer profile frame 1. The upper end of the window frame 13 is mounted with a second seal 15, and the second seal 15 is a rubber sealing strip with a U-shaped cross section. By means of the second seal 15, rainwater can be reduced from entering the room between the window frame 13 and the connecting portion 11.

Figure 4:
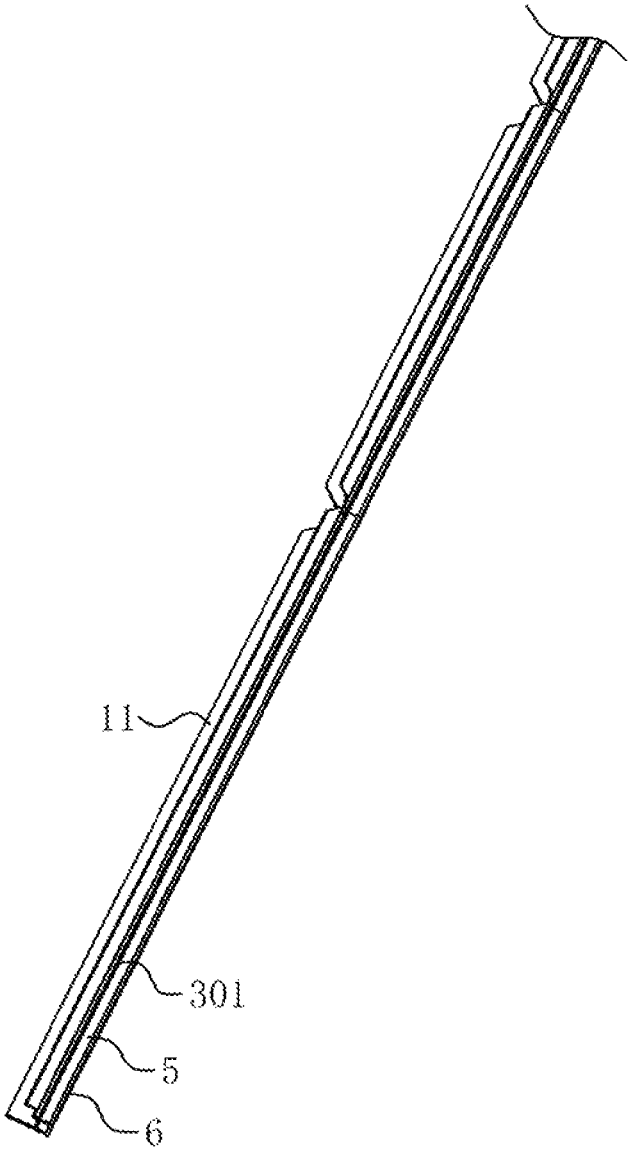
FIG. 4 is a partial schematic diagram of a water baffle, a second fixing piece and a connecting portion before being bent according to an embodiment of the present application.

As shown in FIGS. 3 and 4, the inner frame further includes a mullion 12, and the mullion 12 is mounted on the water baffle 301 via the connecting portion 11. The glass plate 2 in this embodiment is pressed against the support strip and the first seal 9. The second seal 15 is mounted on the window frame 13, and when the skylight is closed, the connecting portion 11 is pressed against the second seal 15. The mullion 12 can increase the structural strength of the skylight. Most of the existing skylight is opened and closed by an air cylinder. The piston rod of the air cylinder is mounted on the mullion 12, so that the damage of the skylight is reduced.

An corner brace (not shown in the figure) is mounted between two adjacent outer profiles, the corner brace is in an L shape, and two ends of the corner brace are respectively inserted into a hollow part of the outer profiles. The corner brace connects the adjacent outer profiles, so that the outer profiles are assembled on the annular blocking portion and the glass plate 2 more firmly.

In this embodiment, the annular water blocking portion is formed by bending a water baffle 301, and the second fixing piece 5 and the connecting portion 11 are integrally formed on both sides of the water baffle 301. Furthermore, the bottom of the water baffle 301 protrudes from the lower surface of the second fixing piece 5 and the connecting portion 11, respectively. The protruding portion of the water baffle 301 may play a role of guiding water, that is, guiding rainwater entering the skylight from the collision corner of the outer profile frame 1. If the inner profile frame 3 formed by the water baffle 301, the second fixing piece 5 and the connecting portion 11 is integrally formed, the processing is difficult and the cost is high. When the inner profile frames 3 with different sizes are processed, different dies are needed, and the processing cost is further increased. If the inner profile frame 3 formed by the water baffle 301, the second fixing piece 5 and the connecting portion 11 is formed by welding at the collision corner, and the production process of the skylight is more complicated. The waterproof effect at the welding position of the inner profile frame 3 is poor, particularly after a period of time is used, the inner profile frame 3 is easily cracked at the welding position.

Further, there is provided a method for manufacturing a nail-free and glue-free skylight, and the method includes the following steps.

Step S1, processing an outer profile: cutting two ends of the outer profile, so that four outer profiles are spliced into an outer profile frame 1.

Step S2, processing an inner profile: cutting off the second fixing piece 5 at a portion of a water baffle 301 to be bent, and cutting the connecting portion 11 at a portion of the water baffle 301 to be bent, so that the connecting portion 11 is spliced into a shape matched with the outer profile frame 1, after bending the water baffle 301.

Step S3, molding the inner profile frame 3: bending the water baffle 301 to make two ends of the water baffle 301 abut against each other, and mounting a first seal 9 on the water baffle 301.

Step S4, assembling: placing the inner profile frame 3 on an operation table, placing the glass plate 2 on the inner profile frame 3, and then inserting the outer profile from a side surface of the inner profile frame 3 and the glass plate 2, so that the second fixing piece 5 is snap-fitted into the first fixing piece 4.

The annular water blocking portion is formed by bending one water baffle 301, so that the inner profile frame 3 is easy and quick to process and assemble. Further, the annular water blocking portion is integrated at the collision corner, so that rainwater can be reduced from entering the room from the collision corner of the annular water blocking portion, and the waterproof effect of the skylight is improved. Before the step S4, a heat insulating strip is provided between the second fixing piece and the first fixing piece. In the step S4, an corner brace is inserted between two adjacent outer profiles, and the outer profiles are abutted against the corner brace by an compression device. The corner brace connects the adjacent outer profiles, so that the outer profiles are assembled on the annular blocking portion and the glass plate 2 more firmly. In particular, the compression device may be an existing compression device.

The above are the preferred embodiments of the application, and do not limit the scope of protection of the application accordingly. Therefore, all equivalent changes made in accordance with the structure, shape, and principle of the application shall be covered by the scope of protection of the application.

What is claimed is:

1. A skylight, comprising an outer profile frame, an inner profile frame, a window frame, and a glass plate disposed between the outer profile frame and the inner profile frame, wherein the skylight is mounted on a roof through the window frame, the outer profile frame is formed by splicing a plurality of outer profiles, a first fixing piece is disposed on an inner side surface of the outer profile frame, the inner profile frame comprises an annular water blocking portion disposed along the outer profile frame, the annular water blocking portion is formed by bending a water baffle, a junction of ends of the water baffle directly faces any of the plurality of outer profiles, an outer side surface of the annular water blocking portion is disposed with a second fixing piece, and the first fixing piece is in snap-fit engagement with the second fixing piece.

2. The skylight according to claim 1, wherein a connecting portion is disposed at one side of the water baffle away from the second fixing piece, and a bottom of the water baffle protrudes from a lower surface of the connecting portion.

3. The skylight according to claim 2, wherein when the skylight is closed, a lower end surface of the water baffle is lower than an upper end surface of the window frame.

4. The skylight according to claim 3, wherein the water baffle is provided with a first seal abutting against the glass plate, and the window frame is provided with a second seal abutting against the connecting portion.

5. The skylight according to claim 2, further comprising a mullion, wherein the mullion is mounted on the water baffle via the connecting portion.

6. The skylight according to claim 1, wherein a gap is left between adjacent second fixing pieces.

7. The skylight according to claim 1, wherein a heat insulating strip is provided between the second fixing piece and the first fixing piece.

8. The skylight according to claim 7, wherein a surface of the second fixing piece is provided with a sliding rail, and the heat insulating strip is slidably connected to the sliding rail.

9. A method for manufacturing a skylight, the method comprising the following steps step S1, processing an outer profile, including cutting two ends of the outer profile, so that a plurality of outer profiles are configured to be spliced into an outer profile frame, an inner side surface of the outer profile frame is integrally formed with a first fixing piece;

step S2, processing an inner profile, including cutting off a second fixing piece at a portion of a water baffle to be bent, and cutting a connecting portion at the portion of the water baffle to be bent, so that the connecting portion is configured to be spliced into a shape matched with an inner profile frame after bending the water baffle;

step S3, shaping the inner profile frame, including bending the water baffle to make two ends of the water baffle abut against each other, and mounting a first seal on the water baffle; and step S4, assembling, including placing the inner profile frame on an operation table, placing a glass plate on the inner profile frame, and then inserting the outer profile from a side surface of the inner profile frame and the glass plate, so that the second fixing piece is snap-fitted into the first fixing piece.

10. The method of manufacturing the skylight according to claim 9, wherein:

before the step S4, providing a heat insulating strip between the second fixing piece and the first fixing piece; and in the step S4, inserting a corner brace between two adjacent outer profiles of the plurality of outer profiles, and the two adjacent outer profiles are abutted against the corner brace by a compression device.

* * * * *